US005683311A

United States Patent [19]

Kakiuchi

[11] Patent Number: 5,683,311

[45] Date of Patent: Nov. 4, 1997

[54] WOUND GOLF BALL

[75] Inventor: Shinichi Kakiuchi, Chichibu, Japan

[73] Assignee: Bridgestone Sports Co., Ltd., Tokyo, Japan

[21] Appl. No.: 555,048

[22] Filed: Nov. 8, 1995

[30] Foreign Application Priority Data

Nov. 22, 1994 [JP] Japan ..... 6-312436

[51] Int. Cl.[6] ..... A63B 37/08

[52] U.S. Cl. ..... 473/354; 473/357; 473/378

[58] Field of Search ..... 473/354, 357, 473/378

[56] References Cited

U.S. PATENT DOCUMENTS 5,421,580 6/1995 Kazushige et al. ..... 473/354

FOREIGN PATENT DOCUMENTS

| | | |
|---|---|---|
| A10622092 | 11/1994 | European Pat. Off. . |
| 0397944 | 9/1933 | United Kingdom . |
| 0645311 | 10/1950 | United Kingdom . |
| 0655525 | 7/1951 | United Kingdom . |
| 2229641 | 10/1990 | United Kingdom . |

*Primary Examiner*—George J. Marlo

*Attorney, Agent, or Firm*—Sughrue, Mion, Zinn, Macpeak & Seas, PLLC

[57] ABSTRACT

A thread wound golf ball is provided comprising a liquid center having a center bag filled with a liquid, thread rubber, and a cover. The center bag is filled with 8–12 $cm^3$ of the liquid containing at least 55% by weight of water. The ball is improved in initial speed and travels an increased flying distance.

12 Claims, 1 Drawing Sheet

WOUND GOLF BALL

BACKGROUND OF THE INVENTION

1. Field of the Invention

This invention relates to a thread wound golf ball affording an increased flying distance.

2. Prior Art

Many professional golfers favor thread wound golf balls of the liquid center type wherein a liquid center in the form of a rubber bag filled with a liquid is covered by closely and tightly winding thread rubber thereon and further enclosed with a cover. This is because such golf balls are receptive to spin, easy to control and respond with a pleasant feel on hitting.

However, wound golf balls fly less distances as compared with two-piece golf balls. Various proposals have been made for solving the problem of flying distance. Particularly in connection with wound golf balls of the liquid center type, it is known that the liquid center plays the role of adjusting the entire ball weight and largely dictates the initial speed, spin and feel on hitting. Therefore, attempts were made to modify the liquid center in order to reduce spin as disclosed in Japanese Patent Application Kokai (JP-A) Nos. 168471/1985, 181070/1987 and 255162/1990, and to specify the composition of liquid filled in the center bag as disclosed in Japanese Patent Application No. 126923/1994. Although these wound golf balls often improved in flying distance and spin, there is a desire to further increase the flying distance of wound golf balls of the liquid center type.

SUMMARY OF THE INVENTION

Therefore, an object of the present invention is to provide a wound golf ball of the liquid center type which is improved in flying distance.

The inventors have found that a wound golf ball of the liquid center type can be improved in flying distance by limiting the volume of the liquid with which the center bag is filled to 8 to 12 $cm^3$ and the water content of the liquid to 50% by weight or more based on the entire weight of the liquid.

In prior art wound golf balls of the liquid center type, water or a mixture of water and a specific gravity adjusting agent such as barium sulfate is used as the center liquid and a center bag having an inner diameter of 22.5 to 24.6 mm is filled with 6.0 to 7.8 cm of the liquid. Quite unexpectedly, by using a liquid having a water content of at least 50% by weight and filling a center bag having an inner diameter of 24.8 to 28.4 mm with 8 to 12 cm of the liquid, there is obtained a golf ball which is improved in initial velocity and hence, flying distance.

Briefly stated, the present invention provides a thread wound golf ball comprising a liquid center having a center bag filled with a liquid, thread rubber Wound on the liquid center, and a cover, wherein the liquid has a volume of 8 to 12 $cm^3$ and contains at least 50% by weight of water.

BRIEF DESCRIPTION OF THE DRAWINGS

The sole FIGURE.

DETAILED DESCRIPTION OF THE INVENTION

Figure 1:
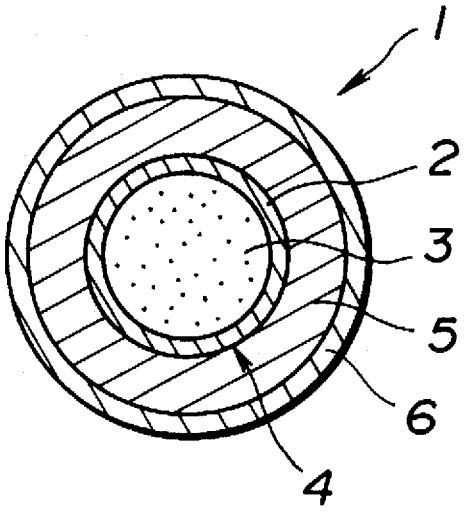
FIG. 1 is a cross-sectional view of one exemplary wound golf ball according to the present invention.

Referring to FIG. 1, a thread wound golf ball 1 includes a liquid center 4 in the form of a center sphere or bag 2 filled with a liquid 3, a thread rubber layer 5, and a cover 6.

The liquid center consists of a center bag and a fill liquid. The liquid with which the center bag is filled may be selected from well-known liquids, for example, water, mixtures of water with fine powder such as barium sulfate, zinc white, and silica, and mixtures of water with sodium sulfate. Water should occupy at least 50% by weight, preferably 55 to 100% by weight, more preferably 80 to 100% by weight of the liquid. If the water content is less than 50%, the ball becomes low in restitution. The specific gravity of the liquid may be suitably selected in consideration of the overall weight of the ball although it is preferably 1.0 to 2.0, especially 1.0 to 1.7.

The center bag is filled with the liquid in a volume of 8 to 12 $cm^3$, preferably 8.5 to 11.5 cm. If the liquid volume is less than 8 $cm^3$, the ball becomes low in restitution. If the liquid volume exceeds 12 $cm^3$, the liquid center must have a larger diameter which fails to provide appropriate ball hardness and renders the center prone to deformation upon thread winding.

The center or rubber bag which is filled with the liquid to form the liquid center may be selected from conventional ones. Preferably the bag has an inner diameter of 24.8 to 28.4 mm, especially 25.3 to 28.0 mm and a gage or thickness of 1.5 to 3.0 mm, especially 1.8 to 2.5 mm while it is filled with 8 to 12 $cm^3$ of the above-mentioned liquid. The center bag is filled with the liquid to form the liquid center which preferably has an outer diameter of 29 to 33 mm, especially 30 to 32 mm from the standpoints of flying distance and the center's durability.

Thread rubber of a conventional type is wound on the liquid center by a conventional technique. For example, cram thread is wound by a conventional technique. The wound liquid center is then enclosed with a cover by a conventional technique. The cover may be formed of a conventional cover material such as, for example, an ionomer resin and balata rubber. The cover preferably has a radial thickness of 1.0 to 2.5 mm, especially 1.2 to 2.0 mm.

The wound golf ball thus completed should have a diameter and weight complying with the golf rules, namely a diameter of at least 42.67 mm and a weight of up to 45.92 g.

EXAMPLE

Examples of the present invention are given below by way of illustration and not by way of limitation.

Examples 1–6 and Comparative Examples 1–6

Twelve liquid centers of the weight and outer diameter shown in Table 1 were prepared by forming center bags of the composition and size shown in Table 1 and filling the center bags with liquids of the composition shown in Table 1.

TABLE 1

| | Example | | | | | | Comparative Example | | | | | |
|---|---|---|---|---|---|---|---|---|---|---|---|---|
| | 1 | 2 | 3 | 4 | 5 | 6 | 1 | 2 | 3 | 4 | 5 | 6 |
| Center bag composition | | | | | | | | | | | | |
| Natural rubber | 100 | 100 | 100 | 100 | 100 | 100 | 100 | 100 | 100 | 100 | 100 | 100 |
| Zinc white | 40 | 40 | 40 | 145 | 220 | 145 | 30 | 330 | 30 | 260 | 10 | 190 |
| Process oil | — | — | — | 25 | 25 | 25 | — | 30 | — | 25 | — | 25 |
| Stearic acid | 1.0 | 1.0 | 1.0 | 1.0 | 1.0 | 1.0 | 1.0 | 1.0 | 1.0 | 1.0 | 1.0 | 1.0 |
| Vulcanization promoter | 1.5 | 1.5 | 1.5 | 1.5 | 1.5 | 1.5 | 1.5 | 1.5 | 1.5 | 1.5 | 1.5 | 1.5 |
| Sulfur | 2.5 | 2.5 | 2.5 | 2.5 | 2.5 | 2.5 | 2.5 | 2.5 | 2.5 | 2.5 | 2.5 | 2.5 |
| Center bag | | | | | | | | | | | | |
| Specific gravity | 1.21 | 1.21 | 1.21 | 1.66 | 1.97 | 1.66 | 1.17 | 2.33 | 1.17 | 2.11 | 1.01 | 1.85 |
| Hardness, JIS-A | 52 | 52 | 52 | 53 | 56 | 53 | 51 | 61 | 51 | 56 | 51 | 54 |
| Thickness, mm | 2.3 | 2.3 | 2.3 | 2.3 | 2.3 | 2.3 | 2.3 | 2.3 | 2.3 | 2.3 | 2.3 | 2.8 |
| Liquid | | | | | | | | | | | | |
| Composition* | water + barium sulfate | water + barium sulfate | water + barium sulfate | water + sodium sulfate | water | water + sodium sulfate | water + barium sulfate | water | water + barium sulfate | water | water + barium sulfate | water |
| Barium sulfate content, g | 7.0 | 7.9 | 7.6 | — | — | — | 7.8 | — | 7.5 | — | 8.8 | — |
| Volume, $cm^3$ | 8.7 | 9.9 | 11.1 | 8.7 | 8.7 | 9.9 | 7.1 | 7.1 | 7.7 | 7.7 | 8.7 | 7.7 |
| Water content, % | 57 | 57 | 60 | 80 | 100 | 80 | 47 | 100 | 50 | 100 | 49 | 100 |
| Liquid center | | | | | | | | | | | | |
| Weight, g | 19.3 | 21.5 | 22.9 | 19.6 | 19.6 | 21.5 | 16.5 | 16.7 | 17.7 | 17.9 | 19.3 | 19.6 |
| Outer diameter, mm | 30 | 31 | 32 | 30 | 30 | 31 | 28 | 28 | 29 | 29 | 30 | 30 |

* The mixture of water and sodium sulfate was an aqueous solution containing 20% by weight of sodium sulfate. The mixture of water and barium sulfate was a paste consisting of 100 parts by weight of barium sulfate, 6 parts by weight of sodium carboxymethyl cellulose thickener, 4 parts by weight of dodecylbenzene sulfonic acid surfactant, and 30 parts by weight of water, and the paste was diluted with water for adjustment.

Thread rubber (cram thread rubber) was wound on each of the liquid centers by a conventional winding technique to form a wound core (liquid center+thread rubber) having a diameter of about 40 mm. The wound core was enclosed with a pair of half shells of a balata cover material of the following composition.

| Balata cover composition | Parts by weight |
|---|---|
| Trans-1,4-polyisoprene | 60 |
| Hi-styrene resin | 20 |
| Natural rubber | 20 |
| Zinc oxide | 10 |
| Titanium oxide | 10 |
| Stedric acid | 1.0 |
| Sulfur | 1.5 |

The cover was integrated to the wound core by heat compression molding at about 85° C. for 10 minutes, obtaining a ball having a diameter of 42.7 mm. The ball was immersion vulcanized for 48 hours, completing a wound golf ball. The cover of the ball had a radial thickness of about 1.6 mm.

The wound golf balls thus obtained were examined for various properties. The results are shown in Table 2.

TABLE 2

| | Example | | | | | | Comparative Example | | | | | |
|---|---|---|---|---|---|---|---|---|---|---|---|---|
| | 1 | 2 | 3 | 4 | 5 | 6 | 1 | 2 | 3 | 4 | 5 | 6 |
| Ball outer diameter (mm) | 42.67 | 42.68 | 42.67 | 42.67 | 42.68 | 42.68 | 42.67 | 42.67 | 42.68 | 42.68 | 42.67 | 42.67 |
| Ball weight (g) | 45.2 | 45.5 | 45.5 | 45.1 | 45.1 | 45.4 | 45.2 | 45.2 | 45.1 | 45.2 | 45.2 | 45.4 |
| Ball hardness[1)] (mm) | 2.91 | 2.90 | 2.92 | 2.89 | 2.90 | 2.91 | 2.90 | 2.90 | 2.89 | 2.92 | 2.91 | 2.90 |
| Initial speed[2)] (m/s) | 65.4 | 65.5 | 65.6 | 65.7 | 65.7 | 65.8 | 64.8 | 65.0 | 65.1 | 65.2 | 65.2 | 65.1 |

[1)]ball hardness: a distortion of a ball under a load of 100 kg

[2)]Using a hitting machine, a ball was hit by a driver at a head speed of 45 m/s. The result is an average of 12 tests for each Example.

1) ball hardness: a distortion of a ball under a load of 100 kg
2) Using a hitting machine, a ball was hit by a driver at a head speed of 45 m/s. The result is an average of 12 tests for each Example.

It is evident from Table 2 that the golf balls within the scope of the invention (Examples 1–6) show a satisfactory initial speed.

There has been described a wound golf ball wherein the volume and water content of the fill liquid of the liquid center are specified such that the ball will fly a good distance.

Japanese Patent Application No. 312436/1994 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

I claim:

1. A thread wound golf ball comprising a liquid center having a center bag filled with a liquid, thread rubber wound on the liquid center, and a cover, wherein the liquid with which the center bag is filled has a volume of 8 to 12 cm and contains at least 55% by weight of water based on the weight of the liquid.

2. The golf ball of claim 1 wherein the center bag has an inner diameter of 24.8 to 28.4 mm.

3. The golf ball of claim 1 where the center bag has a thickness of 2.3 to 3.0 mm.

4. The golf ball of claim 1 wherein the center bag has a specific gravity in the range of 1.21 to 1.97.

5. The golf ball of claim 1 wherein the liquid contains at least 80% by weight of water based on the weight of the liquid.

6. The golf ball of claim 1 wherein said cover is an ionomer resin.

7. The golf ball of claim 1 wherein said cover is a balata rubber.

8. A thread wound golf ball comprising a liquid center having a center bag filled with a liquid, thread rubber wound on the liquid center, and a cover, wherein the liquid with which the center bag is filled has a volume of 8 to 12 $cm^3$ and contains at least 55% by weight of water based on the weight of the liquid, the center bag has an inner diameter in the range of 24.8 to 28.4 mm, a thickness in the range of 2.3 to 3.0 mm, and a specific gravity in the range of 1.21 to 1.97.

9. The golf ball of claim 8 wherein the liquid contains at least 80% by weight of water based on the weight of the liquid.

10. The golf ball of claim 8 wherein said cover is an ionomer resin.

11. The golf ball of claim 8 wherein said cover is a balata rubber.

12. The golf ball of claim 8 wherein said cover has a radial thickness in the range of 1.0 to 2.5 mm.

* * * * *